United States Patent [19]

Carnahan

[11] 4,350,457

[45] Sep. 21, 1982

[54] GOLF BALL WASHER AND CLUB CLEANER

[76] Inventor: G. E. Carnahan, 1007 Regent Ter., Kirkwood, Mo. 63122

[21] Appl. No.: 185,935

[22] Filed: Sep. 10, 1980

[51] Int. Cl.[3] ..... A63B 47/04

[52] U.S. Cl. ..... 401/11; 15/21 A; 15/104.92; 273/32 B; 401/139; 401/183

[58] Field of Search ..... 401/9–11, 401/183, 139; 15/105, 21 A, 104.92; 273/32 B; 222/207

[56] References Cited

U.S. PATENT DOCUMENTS

| | | | |
|---|---|---|---|
| 2,622,257 | 12/1952 | Lemonds et al. | 15/21 A |
| 2,624,900 | 1/1953 | Smith | 401/11 |
| 2,707,292 | 5/1955 | Lustbader | 401/139 |
| 2,750,615 | 6/1956 | Brazeman | 401/183 |
| 2,752,069 | 6/1956 | Welsh | 222/207 |
| 3,047,896 | 8/1962 | Gunderson | 273/32 B X |
| 3,085,282 | 4/1963 | Mesick et al. | 401/10 |
| 3,087,189 | 4/1963 | Scanlon | 401/11 |
| 3,105,257 | 10/1963 | Blagden | 15/105 |
| 3,226,760 | 1/1966 | Grote | 401/139 |
| 3,319,837 | 5/1967 | Mueller | 401/183 |
| 3,453,675 | 7/1969 | Barton et al. | 15/104.92 |
| 3,485,563 | 12/1969 | Chennell | 401/183 |
| 4,210,974 | 7/1980 | Stoltzman | 15/21 A |

FOREIGN PATENT DOCUMENTS

| | | | |
|---|---|---|---|
| 444814 | 2/1968 | Switzerland | 401/183 |
| 619324 | 3/1949 | United Kingdom | 15/21 A |

*Primary Examiner*—Steven A. Bratlie
*Attorney, Agent, or Firm*—Cohn, Powell & Hind

[57] ABSTRACT

A golf ball cleaner including a flexible container having a threaded neck portion at one end and a closure element threadably received by the neck. A cleaning bowl is carried at one end of the flexible container, the cleaning bowl having a cup portion and a passage communicating between the cup portion and the flexible container interior. A dip tube is disposed within the flexible container and communicates with the cup portion through the passage for providing a passage between the flexible container interior and the cup portion. The cup portion of the cleaning bowl includes an interior surface having an inwardly directed cleaning point projections. A bail is included for suspending the golf ball cleaner from a golf bag.

A modified golf ball cleaner includes a plurality of teeth projecting radially outwardly from the margin of the cleaning bowl, said teeth being substantially triangularly-shaped to facilitate cleaning golf club face grooves.

1 Claim, 4 Drawing Figures

GOLF BALL WASHER AND CLUB CLEANER

BACKGROUND OF THE INVENTION

This invention relates to a golf ball washer in general and particularly to a golf ball washer of the type having a flexible squeeze container with a dip tube for supplying cleaning fluid for cleaning golf balls.

Prior golf ball cleaners, such as the one disclosed in U.S. Pat. No. 3,087,189 in which a cleaning liquid is supplied to a cleaning chamber through an orifice, require that the container be inverted. That is, the orifice must be positioned at the bottom of the container in order for liquid to be expelled from the container. The disadvantage of this is that, in such a position, the expelled liquid will tend to run from the golf ball cleaner rather than being retained in the cleaning area. Thus, when cleaning a golf ball in such a device it is necessary to hold the ball up in the cleaning area rather than allowing the ball to rest in the cleaning area. Another disadvantage of prior cleaners is the use of a sponge-like surface in the golf ball cleaning area. The reason for this is that it is difficult to effectively clean the dimpled area of a golf ball using a sponge like material. Such a cleaning surface also tends to grip the golf ball rather than allowing it to rotate freely.

SUMMARY OF THE INVENTION

This golf ball cleaner provides a device which can be utilized in an upright position enabling the cleaning bowl both to hold liquid expelled from the container, and to support the golf ball being cleaned. The cleaning bowl surface is bristle-like to facilitate cleaning of the surface of the golf ball including the dimpled areas.

The golf ball cleaner includes a flexible container having a threaded neck portion projecting outwardly from one end of the container; a closure element is threadably received by the threaded neck portion, a cleaning bowl, having a cup portion and a passage communicating between the cup portion and the flexible container interior, is carried at one end of the flexible container, and a dip tube is disposed within the flexible container and communicates with the cup portion through the passage for providing a passage between a flexible container interior and the cup portion.

In one aspect of the invention the closure element includes the cleaning bowl. In another aspect of the invention, the cleaning bowl is integrally formed in one end of the flexible container with the threaded neck portion being formed in the other end of the flexible container.

In one aspect of the invention, the cup portion of the cleaning bowl includes an interior surface having a plurality of inwardly directed cleaning point projections. In another aspect of the invention the inwardly directed cleaning point projections are integrally formed with the cleaning bowl and the diameter defining the tips thereof is greater than the diameter of the ball being cleaned.

In yet another aspect of the invention, the closure element includes a bail for suspending the golf ball cleaner from a golf bag.

In one aspect of the invention, the cleaning bowl includes a margin having a plurality of projecting teeth. In another aspect of the invention, the closure element margin includes a substantially smooth upper surface and the teeth project radially outwardly from the margin, the teeth being substantially triangularly shaped ridges having radially remote cleaning edges for cleaning the grooves in the face of a golf club.

In still another aspect of the invention the cleaner includes an elongate flexible member for attachment to a golf bag.

DESCRIPTION OF THE PREFERRED EMBODIMENT

Figure 1:
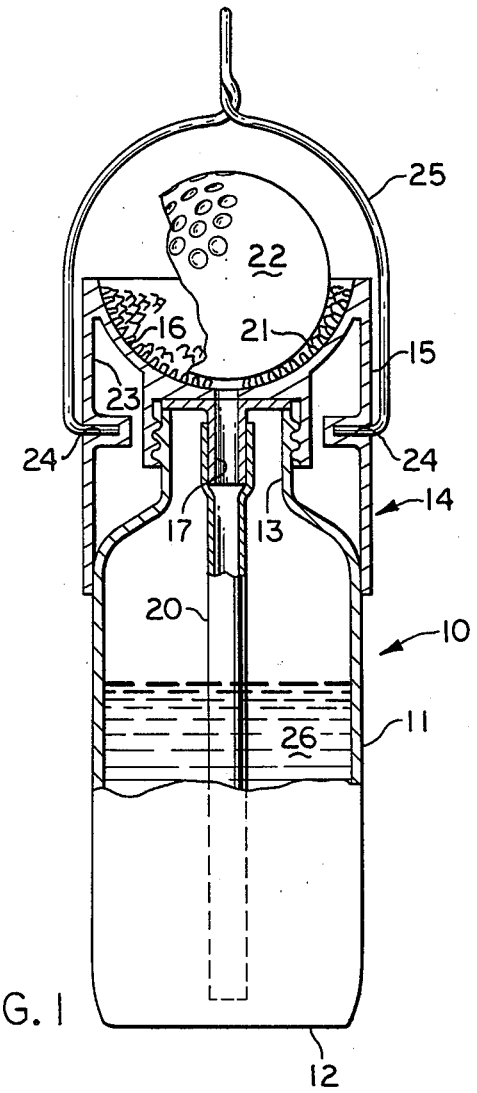
FIG. 1 is a front elevational view, partially in cross-section, of a golf ball cleaner.

Referring now by characters of reference to the drawings and first to FIG. 1, it will be understood that the golf ball cleaner indicated generally by 10 includes a flexible container 11 providing a squeeze bottle of elastomeric material, said container having a closed lower end 12 and a threaded neck portion 13 projecting outwardly at its upper end. A closure element 14 is threadably received by the neck portion 13.

More specifically, the closure element 14 includes a cleaning bowl 15 of plastic material such as nylon, polyethylene or the like having a generally concave, substantially hemispherical cup portion 16 and a tubular adaptor portion 17 providing a passage which communicates between the cup portion 16 and the interior of the flexible container 11. A dip tube 20, attached to the adaptor portion 17, is disposed within the flexible container 11 and extends from the adaptor portion 17 to a position near the lower end 12 for providing a passage between the interior of the flexible container 11 and the cup portion 16.

The interior surface of the cup portion 16 includes a plurality of inwardly directed cleaning point projections 21 forming bristle-like elements for cleaning a golf ball 22 received within the cup portion 16. The cleaning point projections 21 can be of a plastic material integrally formed with the cleaning bowl 15 or can be a separate portion attached as by adhesive, to the cleaning bowl 15.

The closure element 14 includes a cylindrically shaped outer wall 23 which has opposed side opening 24 for receiving the ends of a wire bail 25. The bail 25 includes an upper looped end and can be utilized for supporting the golf ball cleaner 10 from a golf bag (not shown). A cleaning fluid 26, such as water with or without soap, is held within the flexible container.

Figure 2:
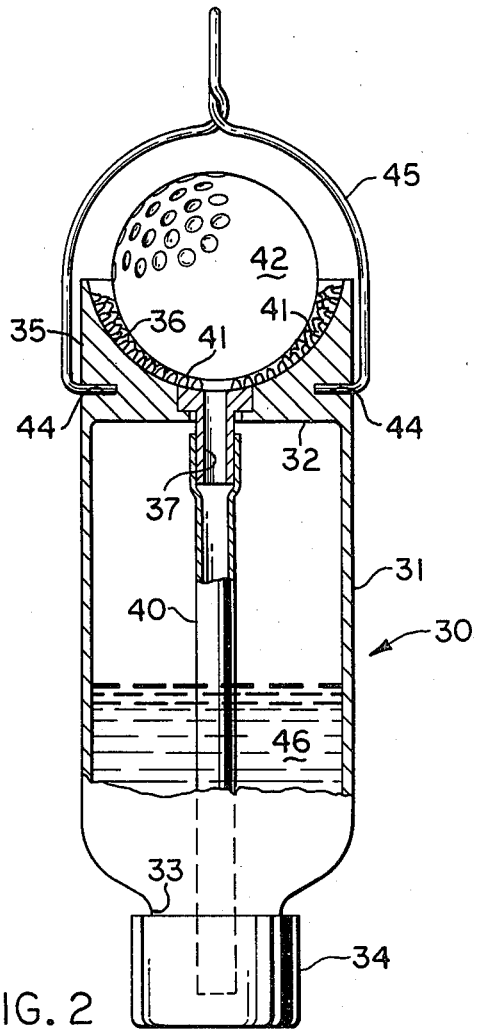
FIG. 2 is a front elevational view, partially in cross-section of a modified golf ball cleaner.

Referring now to FIG. 2, a modified golf ball washer 30 is illustrated, which includes a flexible container 31 having a upper end 32 and a threaded neck portion 33 projecting outwardly at its lower end. A cap 34, constituting a closure element, is threadably received by the neck portion 33, for closing the neck portion.

More specifically, the upper end 32 includes a cleaning bowl 35, which is integrally formed with the flexible container and of plastic material such as nylon, polyethylene, or the like. The cleaning bowl 35 includes a generally concave cup portion 36 which is substantial hemispherical in shape. A tubular adaptor portion 37 in the cleaning bowl 35 provides a passage between the interior of the flexible container 31 and the cup portion 36. A dip tube 40 attached to the adaptor portion 37 is disposed within the flexible container 31 and extends from the adaptor portion 37 to a position within the neck portion 33 for providing a passage between the interior of the flexible container 31 and the cup portion 36.

The interior surface of the cup portion 36 includes a plurality of inwardly directed cleaning point projections 41 forming bristle-like elements for cleaning a golf ball 42 received within the cup portion 36. The cleaning point projections 41 can be integrally formed with the cleaning bowl 35 or separately attached to said bowl.

The upper end 32 includes opposed side openings 44 for receiving the ends of a wire bail 45, said bail having an upper loop portion for attachment to a golf bag. The container 31 holds cleaning fluid 46 as in the device disclosed in FIG. 1.

Figure 3:
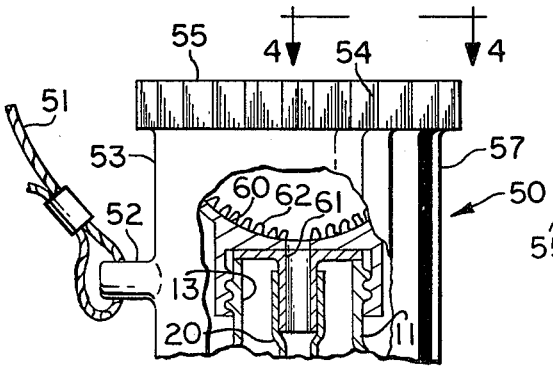
FIG. 3 is a fragmentary elevational view of a modified golf ball cleaner incorporating a golf club cleaner.
Figure 4:
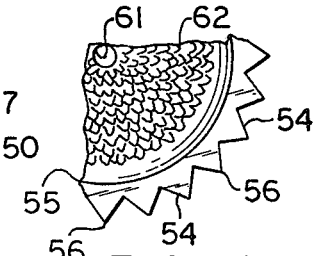
FIG. 4 is a fragmentary plan view taken on line 4—4 of FIG. 3.

Referring now to FIGS. 3 and 4, a modified closure element 50 for use with a flexible container 10 as in FIG. 1, is disclosed.

As shown in FIG. 3, as an alternative to the bail shown in FIG. 1, a cord 51 is attached to a projection 52 on a side wall 53 for suspending the golf ball washer from a golf bag.

Importantly, as best shown in FIG. 4, a plurality of teeth 54 project radially outwardly from an upper margin 55 of the cleaning bowl 57. The upper margin 55 is smooth, while the teeth 54 are substantially triangularly-shaped ridges having radially remote cleaning edges 56 for cleaning golf clubs (not shown). A tubular adaptor portion 61 is provided for communication between the cup portion 60 and the interior of the flexible container 11 and a plurality of inwardly directed cleaning point projections 62 are provided within the bowl 57 as discussed above with respect to FIG. 1. It is of course, understood that while the teeth 54 are shown on the closure element 50, which is similar to the closure element 14 of FIG. 1, the teeth could also be provided on the upper end of a flexible container of the type disclosed in FIG. 2.

It is thought that the structural features and functional advantages of this golf ball cleaner have become fully apparent from the foregoing description of parts, but for completeness of disclosure the use of the cleaner will be briefly discussed.

In the case of the cleaner 10 disclosed in FIG. 1, the closure element 14 is threadedly removable from the flexible container 11 in order to facilitate filling of the container 11 with the cleaning fluid 26. Likewise, the flexible container 31 disclosed in FIG. 2 is filled with cleaning fluid 46 by inverting the flexible container 31 and removing the cap 34. When filled, the closure element 14 and the cap 34 are replaced on their respective flexible containers 11 and 31. In the preferred embodiment, a four ounce translucent squeeze bottle has been found suitable for use as the container 11.

When it is desired to clean a golf ball with the cleaner 10, for example, a ball is placed within the cup portion 16. The flexible container 11 is then squeezed, thereby forcing cleaning fluid 26 up through the dip tube 20 and tubular adaptor portion 17 into the cup portion 16 in order to wet said golf ball 22 and the cleaning point projections 21. By maintaining the flexible container 11 in a squeezed position cleaning fluid 26 can be held in the cup portion 16 in order to wet said golf ball 22 and the cleaning point projections 21. By maintaining the flexible container 11 in a squeezed position cleaning fluid 26 can be held in the cup portion 16 to facilitate the washing. The golf ball 22 is then manually rotated by swirling the fingers or the palm of the hand on the top of the ball thereby causing the cleaning point projections 21 to scrub the ball 22.

The bristle like projections 21 which are semi-rigid, of nylon, polyethylene or the like, allow the ball 22 to rotate freely while lightly abrading or brushing the golf ball. In the preferred embodiment, the diameter defining the tips of projections 21 is somewhat greater than the diameter of the golf ball 22 which has been found to facilitate the cleaning action. A defined tip diameter of 1.8 inches has been found suitable for cleaning a golf ball of 1.68 inches in diameter, said cleaning points being about 1/16 inches long, 1/32 inch in diameter and spaced at 1/16 inch apart. Preferrably, the sides of the cup portion 16 extend above the equator of the golf ball. Once cleaned, the ball 22 can be removed from the cup portion 16 and 36 and dried with a towel (not shown). Any excess fluid 26 in the cup portion 16 will drain back into the flexible container 11 when the squeezing pressure on the container 11 is relaxed, thereby conserving the said fluid.

The golf ball washer 10 is designed to be suspended from the golf bag (not shown) by the bail 25 so that the fluid 26 will not leak from the flexible container 11. This arrangement allows the golf ball cleaner 10 to be fully utilized for cleaning golf balls in an upright position, while still attached to the golf bag, if desired.

The modified closure element 50 shown in FIGS. 3 and 4 includes teeth 54 which can be utilized for cleaning golf clubs. In the preferred embodiment, the teeth 54 are about $\frac{1}{8}$ inch in projection length and equally spaced at about $\frac{1}{4}$ inch apart around the rim, approximately twenty-four teeth being provided. By this arrangement, one tooth projects sufficiently beyond its adjacent teeth so that a single tooth will engage and clean only one groove at a time, it being understood that the spacing of golf club grooves is not standardized. When it is desired to clean a golf club (not shown) the club face is positioned parallel to the ground, dirty face up, while the cleaning fluid 26 is squeezed into the cup portion 60 by applying pressure to the flexible container 11 to raise about one-half teaspoon of fluid in said cup portion. With the pressure still applied to the flexible container 11 to hold the fluid 26 in the cup portion 60, the cleaner is tilted to pour the cleaning fluid from the cup 60 onto the club face. The cord 51 which is about one foot long in the preferred embodiment is attached to the closure element 50 with an end of the cord 51 being selectively attached to a golf bag (not shown) for retaining the cleaner when not in use. The cord provides an elongate flexible member providing for the necessary manipulation of said cleaner for cleaning the club face.

Once the club face has been wetted the club can be cleaned by laying the device parallel with the club face and scrubbing the club face with the teeth 54 to remove dirt on the club face; the edges 56 of the teeth 54 being run through the grooves in the club face one groove at a time to plow dirt out of the grooves. The fluid 26 will not leak out of the flexible container 11 when cleaning the club face because, when the container is inverted, the dip tube 20 is above the fluid level. After the wetting and scrubbing it is a simple matter to wipe the club face clean with a towel.

I claim as my invention:

1. A golf ball and club cleaner comprising:

(a) a flexible container having a threaded neck portion projecting outwardly from the container, (b) a closure element threadedly received by the threaded neck portion, the closure element including:

1. a cleaning bowl having a cup portion and a passage communicating between the cup portion and flexible container interior, and
2. a dip tube disposed within the flexible container and communicating with the cup portion through the passage for providing a passage between the flexible container interior and the cup portion, (c) the cup portion of the cleaning bowl including an interior surface having a plurality of inwardly directed cleaning point projections, (d) the cleaning bowl including a margin having a plurality of projecting teeth, (e) the cleaning bowl margin including a substantially smooth upper surface, (f) the teeth projecting radially outwardly from the margin forming substantially triangularly shaped ridges having radially remote cleaning edges, and (g) the flexible container including cleaning fluid and being squeezable to supply fluid to the cup portion for application to the golf club for facilitating cleaning of the golf club with the projecting teeth.

* * * * *